US008950074B2

(12) United States Patent
Hsu

(10) Patent No.: US 8,950,074 B2
(45) Date of Patent: Feb. 10, 2015

(54) SLIDER FOR A CUTTER

(75) Inventor: Chih-Wei Hsu, Chang Hua (TW)

(73) Assignee: SDI Corporation, Changhua (TW)

( * ) Notice: Subject to any disclaimer, the term of this patent is extended or adjusted under 35 U.S.C. 154(b) by 353 days.

(21) Appl. No.: 13/586,101

(22) Filed: Aug. 15, 2012

(65) Prior Publication Data

US 2013/0205599 A1 Aug. 15, 2013

(30) Foreign Application Priority Data

Feb. 15, 2012 (TW) ..... 101202735 A

(51) Int. Cl.
*B26B 3/06* (2006.01)

(52) U.S. Cl.
USPC ..... 30/162; 30/164

(58) Field of Classification Search
USPC ..... 30/162, 164
See application file for complete search history.

(56) References Cited

U.S. PATENT DOCUMENTS

2008/0256808 A1* 10/2008 Levine et al. ..... 30/162
2011/0308092 A1* 12/2011 Lin ..... 30/164

FOREIGN PATENT DOCUMENTS

JP 09164276 A * 6/1997
JP 10179946 A * 7/1998
JP 2008142383 A * 6/2008

* cited by examiner

*Primary Examiner* — Stephen Choi
(74) *Attorney, Agent, or Firm* — Tracy M. Heims; Apex Juris, pllc

(57) ABSTRACT

A slider has an upper sliding element, a lower sliding element and a resilient tab. The upper sliding element has two first engaging segments disposed on an inner side of the upper sliding element. The lower sliding element has two second engaging segments disposed on an outer side facing the inner side of the upper sliding element and engaging the first engaging segments. A tab holding base is formed on and protrudes from the outer side of the lower sliding element and has a chamber defined in the tab holding base. The resilient tab is held in the chamber in the lower sliding element and has two legs. Accordingly, a slider having a structure in a closed condition is provided to prevent objects from entering into the chamber to interfere the operation of the resilient tab and the operation of the slider is smooth.

20 Claims, 6 Drawing Sheets

SLIDER FOR A CUTTER

BACKGROUND OF THE INVENTION

1. Field of the Invention

The present invention relates to a slider, and more particularly to a slider for a cutter to be assembled easily and conveniently.

2. Description of Related Art

To cut papers or the like, a cutter is always widely used and comprises a blade holder, a blade and a slider. The blade is mounted slidably in the blade holder. The slider is mounted slidably on the blade holder and is connected to the blade to push the blade out from the blade holder in different desired lengths to fit with different working needs. With reference to FIG. 6, Taiwan Utility Model No. M390212, entitled to "Slider For A Cutter", discloses a slider comprising an upper sliding element 70, a lower sliding element 72 and a resilient tab 74. A combining tab 702 and a combing slot 722 are formed respectively on the upper and lower sliding elements 70,72 and engaged each other to combine the upper and lower sliding elements 70,72 with each other. Two through holes 724 are formed in the lower sliding element 72. The resilient tab 74 is pressed and mounted on the lower sliding element 72 at a side opposite to the upper sliding element 72. The resilient tab 74 has two legs 742 extending through the through holes 724 and abutting respectively with two pushing blocks 704 on the upper sliding element 70. The legs 742 of the resilient tab 74 engage teeth formed in a blade holder to hold a blade that is connected with the slider at position relative to the blade holder.

However, after the upper and lower sliding elements 70,72 of the slider is combined, the resilient tab 74 is at an outer side of the slider and is in an open condition relative to an outer environment. Therefore, objects will easily enter into the space in which the resilient tab 74 is mounted, and the operation of the resilient tab 74 is interfered. To mount the resilient tab 74 onto the lower sliding element 72, the resilient tab 74 is compressed to deform with force and the operation of the resilient tab 74 is badly influenced due to the deformation. In addition, the combining tab 702 is easily deformed when the combining tab is engaged the combining slot 722, so that the combination of the upper and lower sliding elements 70,72 is unstable.

Japan Patent Publication No. 10-179946, entitled to "Auto-Lock Slider", comprises a resilient tab mounted between an upper sliding element and a lower sliding element. However, the slider of the '946 Patent has the following drawbacks.

1. The '946 Patent has a complicated structure and is difficult in combination. The '946 Patent has an elastic engaging body to hold the resilient tab, but the supporting area provided by the elastic engaging body is too small to hold and to position the resilient tab stably. The operation of the resilient tab of the '946 Patent is not smooth.

2. The upper and lower sliding elements of the '946 Patent are combined with each other via an anti-slipout segment, but the anti-slipout segment of the '946 Patent cannot provide sufficient combining and positioning effects to cause the movement of the slider unsmooth. In addition, the bent segment of the resilient tab of the '946 Patent is easily pressed while the upper and lower sliding assembly are assembling, the operation of the resilient tab is badly influenced.

3. The '946 Patent has two release projections pushing against inner surfaces of the resilient tab to disengage the resilient tab from teeth on a blade holder. With the outward bend of the resilient tab, the recoil force provided by the resilient tab to reengage the tooth is small and insufficient.

Thus, the engagement between the resilient tab with the tooth may be not completed, so the positioning effect provided to the slider is not stable.

To overcome the shortcomings, the present invention tends to provide a slider for a cutter to mitigate or obviate the aforementioned problems.

SUMMARY OF THE INVENTION

The main objective of the invention is to provide a slider for a cutter and that can be assembled easily and conveniently, can prevent other objects from entering into the slider to enable the slider to pushed smoothly, can enhance the stability of the structure and has a labor-saving capability.

The slider has an upper sliding element, a lower sliding element and a resilient tab. The upper sliding element has an inner side, a holding recess, two flanges, two first engaging segments and two protrusions. The holding recess is defined in the inner side of the upper sliding element to define the two flanges on the inner side of the upper sliding element. The first engaging segments are disposed respectively on the flanges. The protrusions are laterally formed one of the flanges. Each protrusion has an end facing to each other and an inclined pushing surface defined in the end of the protrusion. The lower sliding element is combined with the upper sliding element and has an outer side, a tab holding base, two second engaging segments and a through notch. The outer side faces the inner side of the upper sliding element. The tab holding base is formed on and protrudes from the outer side of the lower sliding element and has a chamber defined in the tab holding base. The second engaging segments are disposed respectively on two sides of the tab holding base and respectively engage the first engaging segments on the upper sliding element. The through notch is defined through the side of the tab holding base that faces the inclined pushing surfaces on the upper sliding element. The resilient tab is held in the chamber in the lower sliding element and has two legs. The legs protrude inward from two ends of the resilient tab. Each leg has an engaging end extending out from through notch in the lower sliding element and abutting with the inclined pushing surface of a corresponding one of the protrusions on the upper sliding element.

With such an arrangement, the slider in accordance with the present invention can achieve the following advantages.

1. The upper and lower sliding elements are combined with each other with the engagement between the first and second engaging segments. The resilient tab is kept from being pressed and deformed while the slider is assembled. To assemble the slider in accordance with the present invention is simple and easy, and the structure of the slider in accordance with the present invention can be simplified.

2. The resilient tab is mounted between the upper and lower sliding elements in a closed condition, such that other objects can be prevented from entering into the chamber to interfere the operation of the resilient tab. In addition, because the resilient tab is not pressed and deformed during the assembling of the slider, the resilient tab can provide sufficient recoil force to actually engage the engaging ends of legs of the resilient tab with the teeth on the blade holder.

3. The protrusions laterally formed on the upper sliding element provide an improved structural strength and a sufficient pushing force to the legs of the resilient tab and is not easily damaged or broken. The lateral extending protrusions are not easily deformed and can easily achieve desired sizes during manufacture, so the structure of the protrusions is stable and durable.

4. With the inclined pushing surfaces abutting with outer sides of the engaging ends of the legs of the resilient tab, the movement and bend of the legs can be limited in an inward range, so a large recoil force is provided by the legs to reengage the engaging ends with the teeth.

5. With the inclined pushing surfaces abutting with outer sides of the engaging ends of the legs of the resilient tab, a small force is needed to push the slider to move and to bend the legs and the slider is easily pushed and the movement of the slider is smooth.

6. The curvature of the engaging ends of the legs can be changed to adjust the engagement strength between the engaging ends with the teeth on the blade holder for fitting with different design or use needs. Sounds can occur by the engaging ends bumping with the teeth during the movement of the slider.

Other objects, advantages and novel features of the invention will become more apparent from the following detailed description when taken in conjunction with the accompanying drawings.

DETAILED DESCRIPTION OF PREFERRED EMBODIMENT

Figure 1:
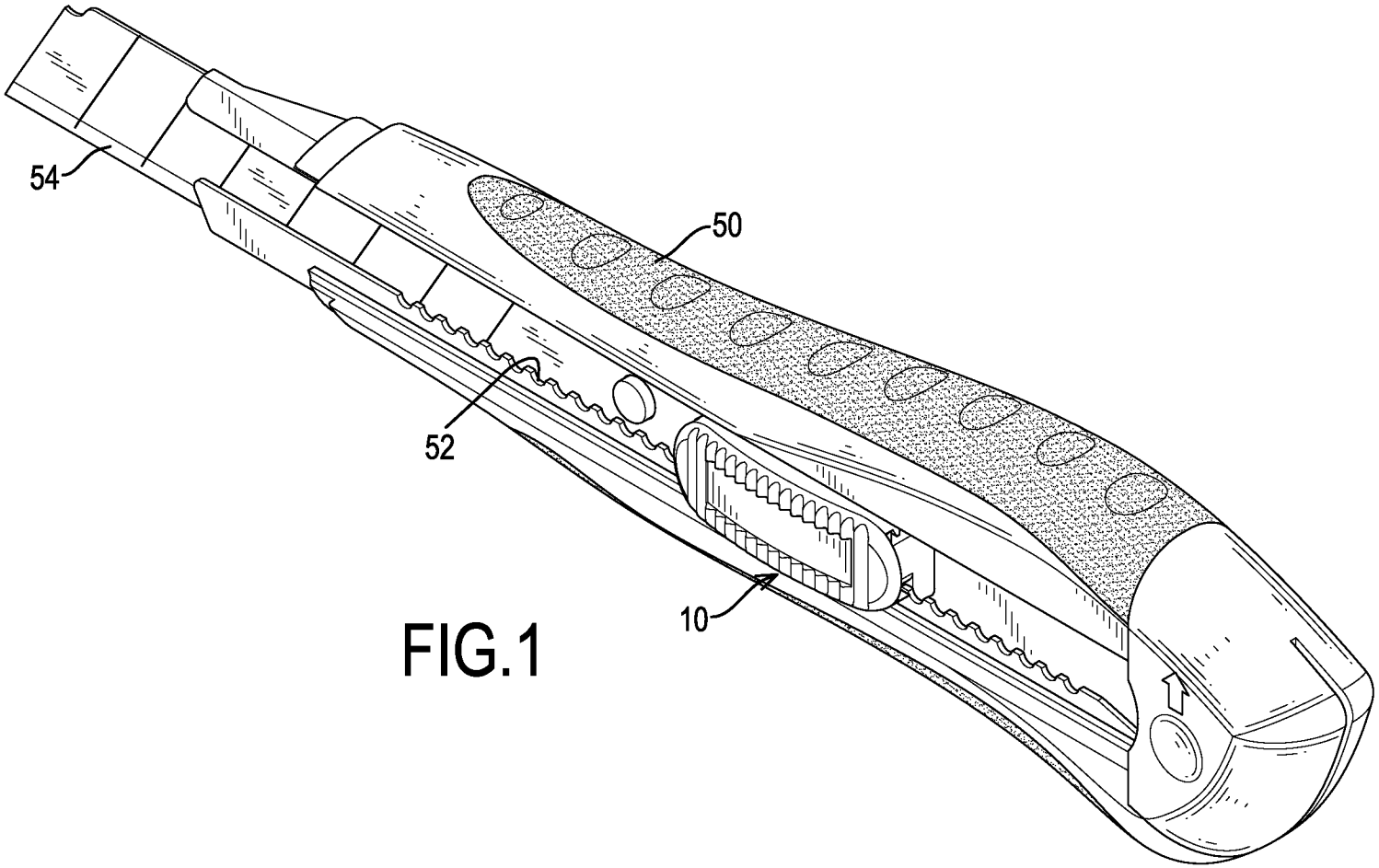
FIG. 1 is a perspective view of a cutter with a slider in accordance with the present invention.
Figure 2:
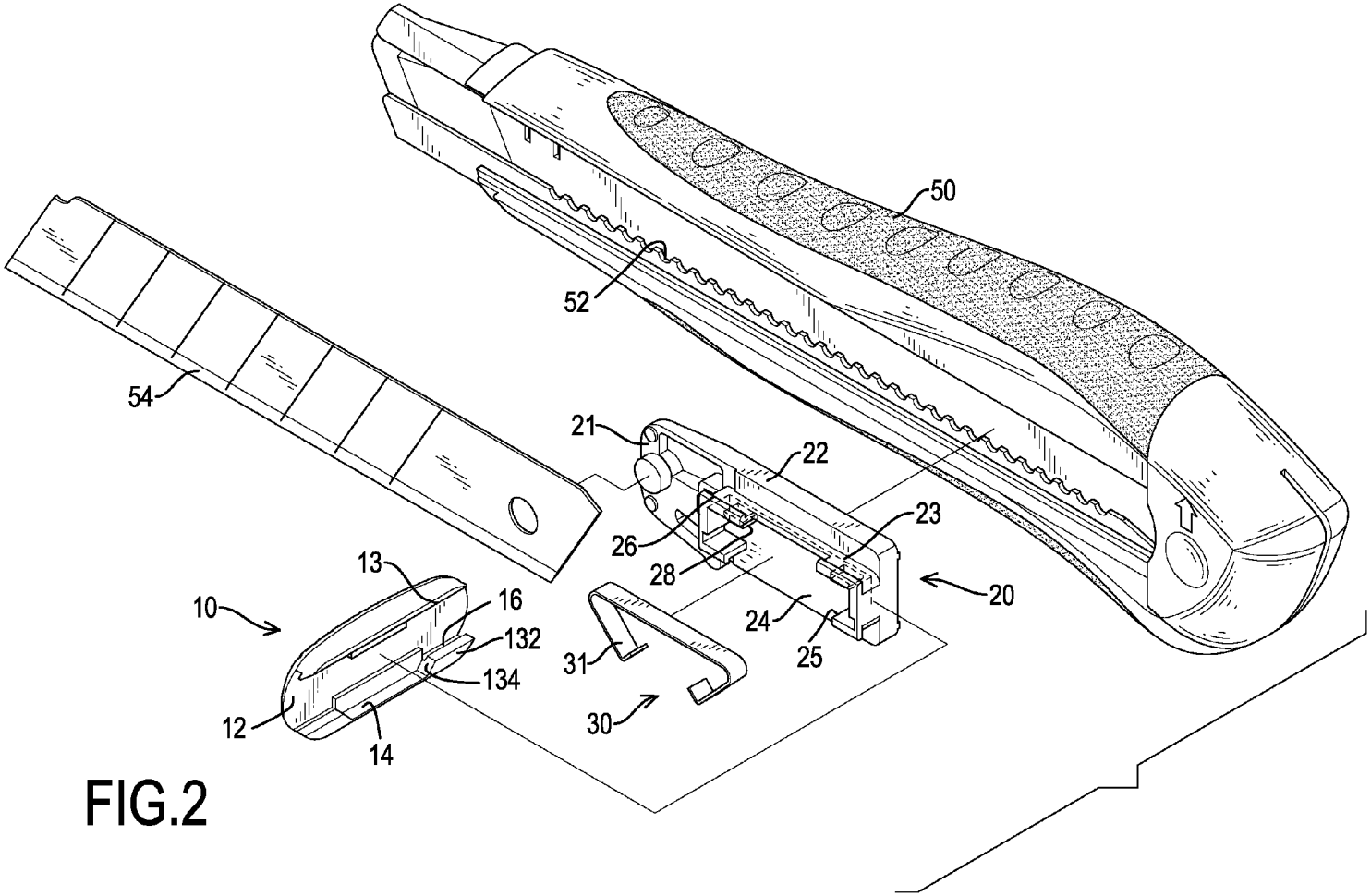
FIG. 2 is an exploded perspective view of the cutter with the slider in FIG. 1.
Figure 3:
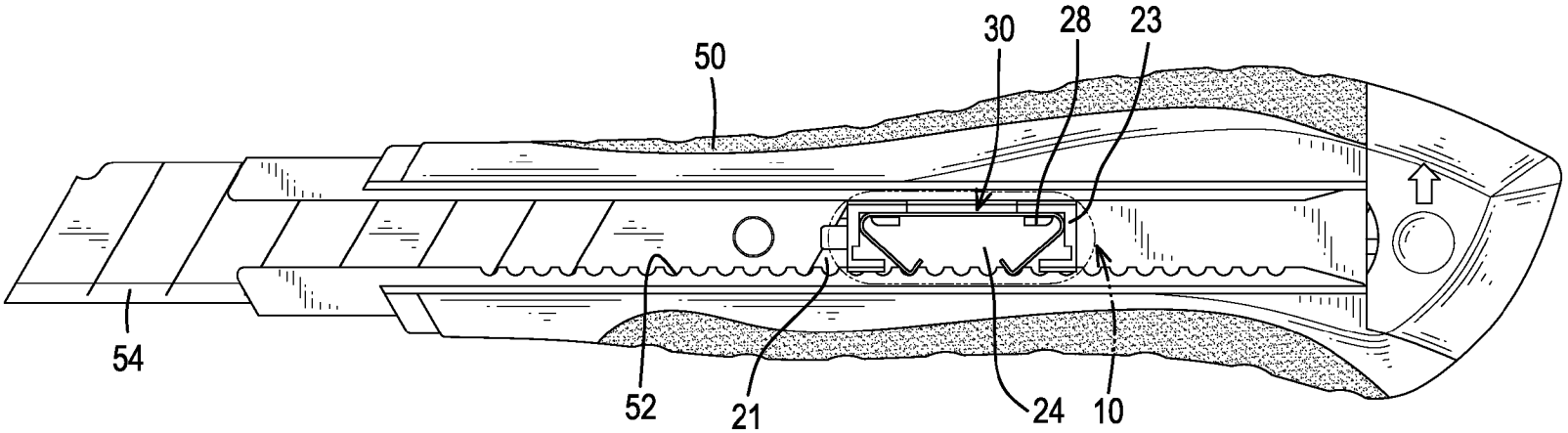
FIG. 3 is a side view of the cutter with the slider in FIG. 1.

With reference to FIGS. 1 to 3, a slider in accordance with the present invention is mounted slidably on a blade holder 50 of a cutter, is connected to a blade 54 of the cutter to push or pull the blade 54 extending out from or retracting into the blade holder 50 and engages teeth 52 formed on the blade holder 50 to provide a positioning effect to the slider with the blade 54. The slider comprises an upper sliding element 10, a lower sliding element 20 and a resilient tab 30.

Figure 4:
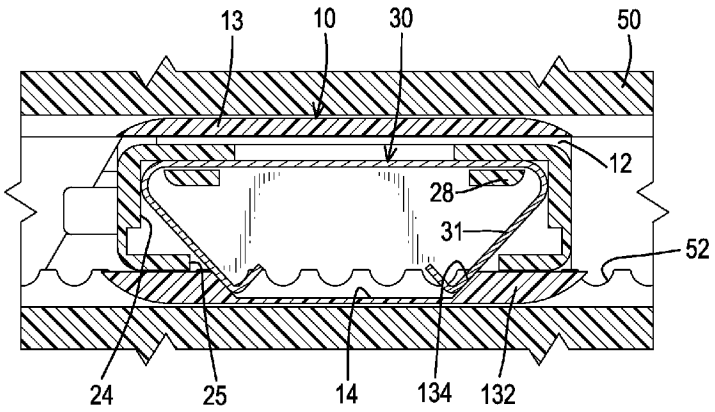
FIG. 4 is an enlarged side view in partial section of the slider in FIG. 1.
Figure 5:
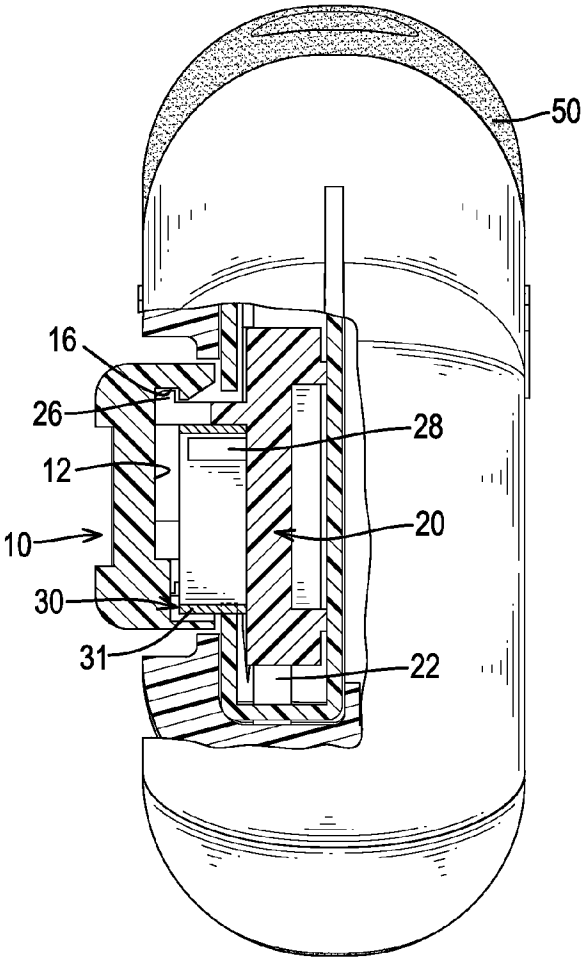
FIG. 5 is an enlarged end view in partial section of the slider in FIG. 3.
Figure 6:
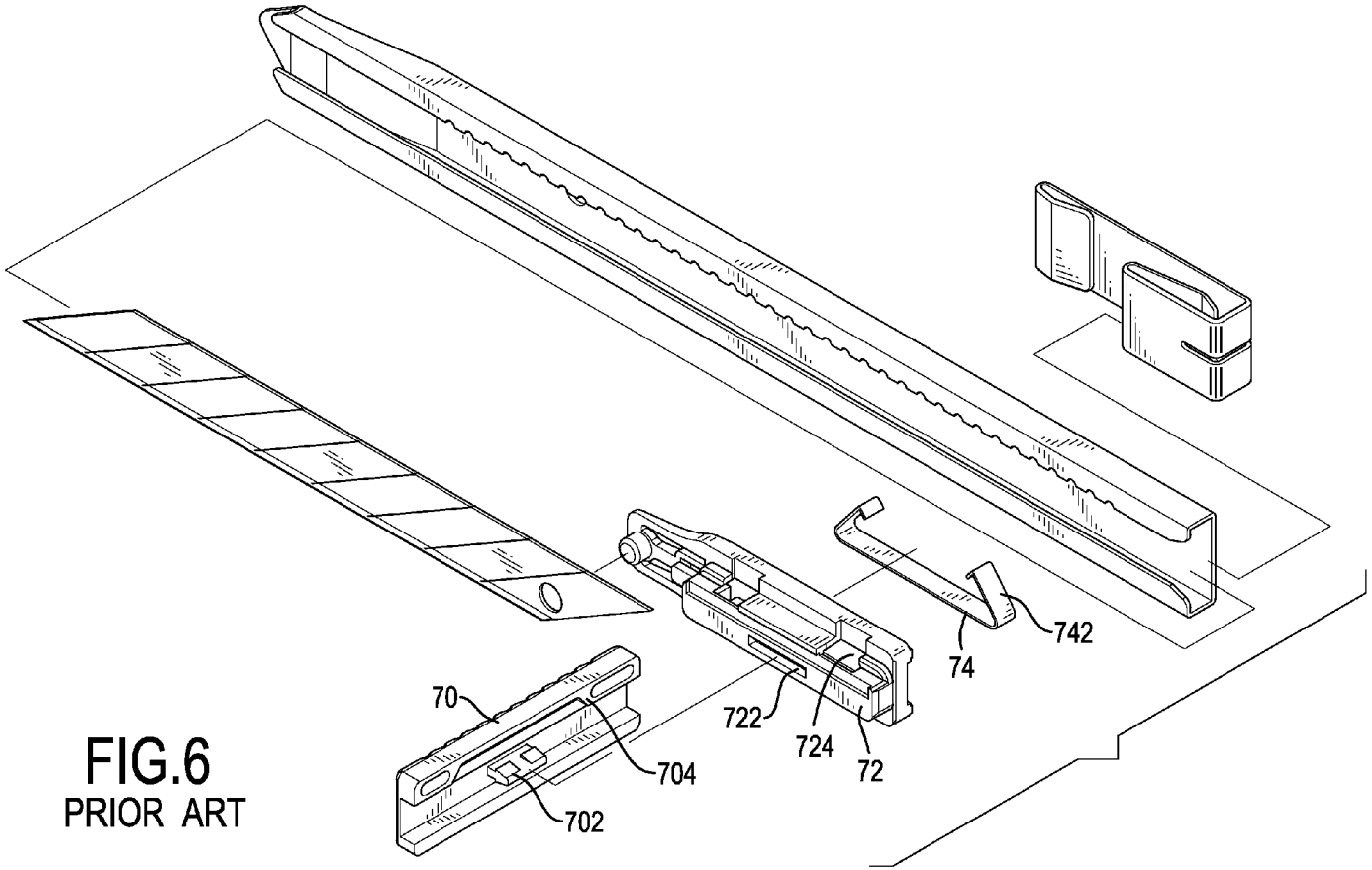
FIG.6 PRIOR ART
FIG. 6 is an exploded perspective view of a cutter with a conventional slider shown in Taiwan Utility Model No. M390212.

With further reference to FIGS. 2, 4 and 5, the upper sliding element 10 has an inner side, a holding recess 12, two flanges 13, an engaging recess 14, two protrusions 132 and two first engaging segments.

The holding recess 12 is defined in the inner side of the upper sliding element 10 to define the two flanges 13 on the inner side of the upper sliding element 10 respectively on two sides of the holding recess 12. Each flange 13 has an inner surface facing the inner surface of the other flange 13. The engaging recess 14 is defined in a middle portion of one of the flanges 13 to form the two protrusions 132 formed respectively and laterally at two ends of the engaging recess 14 and corresponding to each other. Each protrusion 132 has an end facing each other and an inclined pushing surface 134 defined in the end of the protrusion 132. The first engaging segments are formed respectively in the inner surfaces of the flanges 13 and correspond to each other. Preferably, each first engaging segment is an engaging slot 16 formed in the inner surface of one of the flanges 13 and communicating with the holding recess 12.

The lower sliding element 20 is combined with the upper sliding element 10, is mounted slidably on the blade holder 50 of the cutter and has an outer side, a blade mount 21, two rails 22, a tab holding base 23, two second engaging segments, a through notch 25 and two holding tabs 28. The outer side of the lower sliding element 20 faces the inner side of the upper sliding element 10. The blade mount 21 is formed on and protrudes from one end of the lower sliding element 20 and is connected with the blade 54 of the cutter with a stub. The rails 22 are formed on and protrude from two side edges of the lower sliding element 20 and are respectively mounted slidably in channels defined in the blade holder 50 to mount the lower sliding element 20 slidably on the blade holder 50. The tab holding base 23 is formed on and protrudes from the outer side of the lower sliding element 20, is hollow and has two sides and a chamber 24 defined in the tab holding base 23 at a surface facing the upper sliding element 10. The second engaging segments are formed respectively on the sides of the tab holding base 23 and respectively engage the first engaging segments on the upper sliding element 10. Preferably, each second engaging segment is an engaging rib 26 formed on and protruding from one of the sides of the tab holding base 23 and engages the corresponding engaging slot 16 in the upper sliding element 10. Alternatively, the first engaging segments may be engaging ribs, and the second engaging segments may be engaging slots. The first and second engaging segments may be all possible hooks or male or female connectors that can engage, hook or combine with each other and are not limited in the present invention.

The through notch 25 is defined through the side of the tab holding base 23 that faces the engaging recess 14 in the upper sliding element 10. The holding tabs 28 are formed on and protrude from a bottom of the chamber 24 at an interval. Each holding tab 28 has a distance from the inner surface of the chamber 24 of the lower sliding element 20.

The resilient tab 30 is held securely in the chamber 24 in the tab holding base 23 on the lower sliding element 20 and has a thickness that equals to the distance between the holding tabs 28 and the inner surface of the chamber 24. The resilient tab 30 has two legs 31 protruding inward from two ends of the resilient tab 30 and extending out of the through notch 25. Each leg 31 has an engaging end formed at an end of the leg 31 that extends out of the through notch 25 and engaging the teeth 52 on the blade holder 50. The engaging ends of the legs 31 may be curved and respectively abuts with the inclined pushing surfaces 134 on the upper sliding element 10.

To assemble the slider, the resilient tab 30 is mounted into the chamber 24 of the lower sliding element 20 and is inserted between the holding tabs 28 and the inner surface of the chamber 24, such that the resilient tab 30 is held in chamber 24 in position. Then, the upper sliding element 10 is directly attached to the lower sliding element 20 to make the first and second engaging segments engaging each other, so that the slider is assembled. Accordingly, to assemble the slider in accordance with the present invention is simple and easy, and the structure of the slider in accordance with the present invention can be simplified. In addition, the resilient tab 30 is kept from being pressed and deformed while the slider is assembled, the resilient tab 30 can provide a sufficient recoil force to actually engage the engaging ends of legs 31 of the resilient tab 30 with the teeth 52 on the blade holder 50. Accordingly, the structure of the slider in accordance with the present invention is stable and the operation of the slider is smooth.

Furthermore, because the resilient tab 30 is mounted in the chamber 24 that is defined in the lower sliding element 29 at a surface facing the upper sliding element 10, the resilient tab 30 is enclosed inside the chamber 24 and the whole structure of the slider in accordance with the present is in a closed condition. Consequently, objects can be prevented from entering into the chamber 24 to interfere the operation of the resilient tab 30. In addition, the upper and lower sliding elements 10,20 can limit the moving range of the resilient tab 30, such that the resilient tab 30 can be prevented from shaking and the operation of the slider is smooth.

With such an arrangement, the curvature of the engaging ends of the legs 31 can be changed to adjust the engagement strength between the engaging ends with the teeth 52 on the blade holder 50 for fitting with different design or use needs. Sounds can occur by the engaging ends bumping with the teeth 52 during the movement of the slider.

Additionally, with the inclined pushing surfaces 134 abutting with outer sides of the engaging ends of the legs 31 of the resilient tab 30, the legs 31 are pushed to bend inward relative to each other. The movement and bend of the legs 31 can be limited in the range defined by the pushing recess 14 in the upper sliding element 10, so the recoil movement of the legs 31 to engage the teeth 52 is precisely and actually. A small force is needed to push the slider to move and to bend the legs 31, but a large recoil force is provided by the legs 31 to reengage the engaging ends with the teeth 52. Therefore, the slider is easily pushed and the movement of the slider is smooth, and the engaging ends of the resilient tab 30 can be kept from being jammed.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slider for a cutter comprising:

an upper sliding element having an inner side;

a holding recess defined in the inner side of the upper sliding element to define two flanges on the inner side of the upper sliding element;

two first engaging segments disposed respectively on the flanges; and two protrusions laterally formed on one of the flanges, and each protrusion having an end facing to each other and an inclined pushing surface defined in the end of the protrusion;

a lower sliding element combined with the upper sliding element and having an outer side facing the inner side of the upper sliding element;

a tab holding base formed on and protruding from the outer side of the lower sliding element and having a chamber defined in the tab holding base;

two second engaging segments disposed respectively on two sides of the tab holding base and respectively engaging the first engaging segments on the upper sliding element; and a through notch defined through the side of the tab holding base that faces the inclined pushing surfaces on the upper sliding element; and a resilient tab held in the chamber in the lower sliding element and having two legs protruding inward from two ends of the resilient tab, and each leg having an engaging end extending out from the through notch in the lower sliding element and abutting with the inclined pushing surface of a corresponding one of the protrusions on the upper sliding element.

2. The slider as claimed in claim 1, wherein the upper sliding element further has an engaging recess defined in the flange on which the protrusions are formed; and the protrusions are respectively on two ends of the engaging recess.

3. The slider as claimed in claim 2, wherein each first engaging segment is an engaging slot formed in an inner surface of one of the flanges that faces the other flange;

each second engaging segment is an engaging rib formed on and protruding from one of the sides of the tab holding base and engaging a corresponding engaging slot in the upper sliding element.

4. The slider as claimed in claim 3, wherein the lower sliding element further has two holding tabs formed on and protruding from a bottom of the chamber at an interval.

5. The slider as claimed in claim 4, wherein each holding tab has a distance from an inner surface of the chamber and the distance equals to a thickness of the resilient tab.

6. The slider as claimed in claim 5, wherein the engaging end of each leg of the resilient tab is curved.

7. The slider as claimed in claim 6, wherein the lower sliding element further has a blade mount protruding from one end of the lower sliding element and adapted to be connected with a blade of a cutter; and two rails formed on and protruding from two side edges of the lower sliding element.

8. The slider as claimed in claim 1, wherein each first engaging segment is an engaging slot formed in an inner surface of one of the flanges that faces the other flange;

each second engaging segment is an engaging rib formed on and protruding from one of the sides of the tab holding base and engaging a corresponding engaging slot in the upper sliding element.

9. The slider as claimed in claim 8, wherein the lower sliding element further has two holding tabs formed on and protruding from a bottom of the chamber at an interval.

10. The slider as claimed in claim 9, wherein each holding tab has a distance from an inner surface of the chamber and the distance equals to a thickness of the resilient tab.

11. The slider as claimed in claim 10, wherein the engaging end of each leg of the resilient tab is curved.

12. The slider as claimed in claim 11, wherein the lower sliding element further has a blade mount protruding from one end of the lower sliding element and adapted to be connected with a blade of a cutter; and two rails formed on and protruding from two side edges of the lower sliding element.

13. The slider as claimed in claim 1, wherein the lower sliding element further has two holding tabs formed on and protruding from a bottom of the chamber at an interval.

14. The slider as claimed in claim 13, wherein each holding tab has a distance from an inner surface of the chamber and the distance equals to a thickness of the resilient tab.

15. The slider as claimed in claim 2, wherein the lower sliding element further has two holding tabs formed on and protruding from a bottom of the chamber at an interval.

16. The slider as claimed in claim 15, wherein each holding tab has a distance from an inner surface of the chamber and the distance equals to a thickness of the resilient tab.

17. The slider as claimed in claim 1, wherein the engaging end of each leg of the resilient tab is curved.

18. The slider as claimed in claim 2, wherein the engaging end of each leg of the resilient tab is curved.

19. The slider as claimed in claim 1, wherein the lower sliding element further has a blade mount protruding from one end of the lower sliding element and adapted to be connected with a blade of a cutter; and two rails formed on and protruding from two side edges of the lower sliding element.

20. The slider as claimed in claim 2, wherein the lower sliding element further has a blade mount protruding from one end of the lower sliding element and adapted to be connected with a blade of a cutter; and two rails formed on and protruding from two side edges of the lower sliding element.

* * * * *